US005551585A

United States Patent [19]

Huang et al.

[11] Patent Number: 5,551,585

[45] Date of Patent: Sep. 3, 1996

[54] PROCESS FOR THE SURFACE TREATMENT OF LITHOGRAPHIC PRINTING PLATE PRECURSORS

[75] Inventors: Jen-chi Huang, Mt. Kisco; Daniel M. Bourgeois, Mahopac, both of N.Y.

[73] Assignee: Sun Chemical Corporation, Fort Lee, N.J.

[21] Appl. No.: 419,228

[22] Filed: Apr. 10, 1995

[51] Int. Cl.[6] ..... C23F 1/00

[52] U.S. Cl. ..... 216/11; 216/102

[58] Field of Search ..... 216/11, 34, 102

[56] References Cited

U.S. PATENT DOCUMENTS 2,311,047 2/1943 Hagelin ..... 216/102 X 3,615,948 10/1971 Krostewitz ..... 216/102 X 5,074,976 12/1991 Uesugi et al. ..... 216/102 X

*Primary Examiner*—William Powell

*Attorney, Agent, or Firm*—Jack Matalon

[57] ABSTRACT

A process is disclosed to produce a fine honeycomb grain with matte finishing on an aluminum surface in alkaline solution with or without electrical treatment. To achieve the fine honeycomb, a passivation enhancement step is used prior to alkaline etching with or without electricity. The matte appearance with fine honeycomb topography on the aluminum surface is produced by silicating raw aluminum prior to alkaline etching.

11 Claims, No Drawings

PROCESS FOR THE SURFACE TREATMENT OF LITHOGRAPHIC PRINTING PLATE PRECURSORS

FIELD OF THE INVENTION

The present invention relates to the production of aluminum sheets suitable as substrates for lithographic printing plates. The invention particularly relates to a method for chemical passivation of the surface of aluminum sheet precursors of lithographic printing plates to produce a matte appearance with fine honeycomb topography. The invention especially relates to a method for silicating the surface of raw aluminum sheets prior to alkaline etching to produce a suitable lithographic plate substrate precursor at lower capital investment and operating costs.

BACKGROUND OF THE INVENTION

Aluminum is a preferred substrate for the production of lithographic printing plates, especially for large printing runs. The metal combines very attractive mechanical properties in strength, hardness and ductility with specific chemical properties, especially hydrophilicity, that compel its selection for most commercial lithographic printing operations. Aluminum sheet is very adaptable to a variety of surface treatment techniques, i.e., chemical, electrochemical and mechanical, for graining the sheet surface. Graining greatly expands the surface area of the metal to promote the metals surface water holding power for repelling oily inks as well as to promote adhesion with the photosensitive coatings that comprise the finished plate.

The overall process for the surface treatment of aluminum lithographic sheet precursor as practiced in the prior art may involve eight or more separate operations including etching, desmuting, graining, anodizing, and the like. The prior art processes are described in a paper by Jen-Chi Huang entitled "The Trend in Aluminum Surface Treatment Technology for Lithographic Printing Plate Application" published in "Proceedings of the Symposium on Aluminum Surface Treatment Technology", Robert S. Alwitt—Editor, Vol. 86–11 (1986), pages 2–18 by The Electrochemical Society. Each chemical or electrochemical operation is followed by a water rinse.

A known method for treating aluminum sheets to produce bases for printing plates requires eight process steps wherein aluminum sheets are pretreated prior to graining by immersion in an alkaline pre-etch solution and then a desmut solution. The sheets are rinsed with water after the alkaline pre-etch and desmut, respectively. The sheets are then grained typically by either chemical, electrolytic or mechanical graining, and rinsed again with water. The sheets are post-etched after graining by immersion in an alkaline post-etch solution and then a desmut solution, followed by a so-called "liquid contact" and anodized in sulfuric acid. The sheets are rinsed with water after each of the process steps. Finally, the sheets are interlayered before coating with photosensitive material.

The foregoing illustrates the plethora of different and repetitive operations employed in the prior art to produce aluminum sheet suitable for use as a substrate for a lithographic plate.

The object of the invention is to provide a process for the production of surface treated lithographic plate precursor that uses neither mechanical nor electrical processes for graining of the aluminum surface, thereby resulting in less costly and more productive aluminum treatment lines.

SUMMARY OF THE INVENTION

A fine honeycomb grain with matte finishing can be produced on an aluminum surface in alkaline solution with or without electricity. Preferably, the matte finish is produced by non-electrical or non-mechanical means. To achieve the fine honeycomb, a passivation enhancement step is used prior to alkaline etching with or without electricity. The matte appearance with fine honeycomb topography on the aluminum surface is produced by silicating raw aluminum prior to alkaline etching.

More particularly, a process had been discovered for the non-electrical or non-mechanical graining of the surface of aluminum sheet to produce a white, non-reflective matte appearance with fine honeycomb topography for lithographic printing plate production. The process comprises contacting aluminum sheet with an aqueous silicate solution at a temperature between 10° C. and 120° C. for a period of time between 5 seconds and 5 minutes to provide a silicated sheet. The silicated sheet is then etched chemically or electrolytically.

Preferably, the sheet is contacted with silicate at a temperature between 20° C. and 100° C.; more preferably, between 80° C. and 95° C.

DETAILED DESCRIPTION OF THE INVENTION

Processes to produce lithographic substrates presently in use comprise key steps of degreasing and/or etching, desmutting, graining (mechanically, chemically, or electrochemically), post etching, post desmutting, anodizing, and interlayering, followed by a photo sensitive coating.

The accomplishments of the invention are realized by a step of preconditioning the aluminum surface prior to etching by silication, i.e., degreasing and silicating in a solution by adding silicate to an alkaline degreasing solution or dipping raw aluminum in silicate solution only. As the silication progresses the natural oxide film on the aluminum is enhanced for alkaline resistance. The increased alkaline resistance on the aluminum surface is believed to initiate micro pits during the following steps of etching or graining chemically and/or electrochemically.

Without intending to be bound by theoretical consideration, it is held that silicate in the present invention reacts with trace oxide of aluminum on the aluminum surface and forms a composite oxide, or a thin film, that enhances the resistance of aluminum oxide to alkaline solutions. When the natural aluminum oxide is totally removed or substantially reduced by degreasing or pre-etching, an artificially formed, i.e., synthetic, aluminum oxide or artificially formed passivation film is necessary to provide anchorage for silication prior to the following etching step or chemical graining step. Passivity is defined by reference to a metal in the EMF Series, or an alloy composed of such metals, which is considered passive when its electrochemical behavior becomes appreciably less active. A metal is considered to be in a passive state when it substantially resists corrosion in an environment where, thermodynamically, there is a large free energy decrease associated with reaction of the metal from the metallic state to corrosion products. To obtain a passivated surface on aluminum, 5–10 weight percent of sodium bisulfate solution at 35°–40° C. for 15 seconds can be used. The sodium bisulfate desmuts the etched aluminum and passivates the aluminum surface for a better silication. The passivators are usually inorganic oxidizing substances, for example chromates, nitrites, molybdates or bisulfates, etc.

The other passivators are acids for example nitric acid, chromic acid, sulfuric acid, phosphoric acid, hydrofluoric acid, or fatty acids, etc. The silicated passivated film acts as a protective film on the aluminum surface. The etching occurs after certain dwell time after immersing the silicated passivated aluminum in alkaline solution. The non-reaction time before etching starts is characterized as incubation time. The incubation time is about five seconds. When the etching or chemical graining is complete, the silicated, passivated film becomes uniformly pitted to form a honeycomb type of grained surface. It is through these steps that a matte surface forms chemically by this invention.

In addition to sodium silicate, all water soluble neutral or alkaline silicates are useful for the process of the invention. Metal silicates include those prepared from Group IA, IIA, IIIA, IB, IIB, IVB and VIII elements of the Periodic Table. Particular metal silicates or mixture of multiple metal silicates such as sodium silicate, potassium silicate, lithium silicate, barium silicate, calcium silicate, cobalt silicate, iron silicate, aluminum silicate, magnesium silicate, manganese silicate, zinc silicate, or zirconium silicate can be used for this invention.

The silicate solution employed in the present invention has a concentration between 1–25 weight percent silicate; However, a concentration equivalent to about 5 weight percent sodium silicate is preferred.

The passivation film formed on aluminum surface by natural oxidation is normally very thin, i.e., about 10–100 Angstroms. The natural film produces a zincate reading of 15 seconds. It has been found that the silicated natural oxide on aluminum produced by the instant invention gives a zincate reading of 50 seconds or more. The increase in alkaline resistance is caused by the enhancement of the passivation film by silication.

The passivation film on aluminum surface can also be formed artificially by other passivator chemicals, such as nitric acid, phosphoric acid, sulfuric acid, chromic acid, chromates, nitrites, molybdates, ferrates, pertechnetates, phosphates, sulfates, polyphosphates, etc. The artificial passivation can be achieved with the foregoing mentioned chemicals chemically or electrochemically.

The following Examples illustrate the steps employed in the novel process of the invention. The method used to quantify how well silication has been performed involves a determination of the time required for a solution of zinc oxide to deposit zinc on a treated aluminum immersed in the zinc solution. The required immersing time is referred to as the zincate reading and is well known to those skilled in the art. The zincate solution comprises sodium hydroxide and zinc oxide. The zincate solution used in the instant test is prepared from Alumon D powder (Enthone-OMI) in water, about 10 weight percent. A zincate reading of more than 50 seconds is required to conclude that an adequate silication treatment has been achieved.

EXAMPLE 1

A piece of aluminum sheet, AA3003, was cut in 5"×10" sections. The aluminum was dipped in 11% by volume of N-38, a silicate product of Philadelphia Quartz (4.2 weight percent sodium silicate in water) at 75° C. for 60 seconds. The silicated aluminum section was then immersed in a solution containing 150 g/l of Kleen 4901, an alkaline etch product of Betz Chemical, for 15 seconds at 50 degree C. The aluminum section was then rinsed in water and dried.

The optical density of the above treated aluminum was determined to be 0.11 (Optical Densometer—Macbeth) before anodizing, and 0.32 after anodizing. These results correspond with an aluminum surface having a white, non-shiny or non-reflective, matte appearance. The roughness of the treated aluminum was about the same as raw aluminum sheet. A SEM study was carried out and showed that the treated aluminum sheet appears as fine homogeneous and very uniform concave pits or honeycomb at a magnification of 2,000 and 10,000. The size of these pits was noted as being about 0.2–1 micrometers in diameter.

EXAMPLE 2

25"×25" aluminum sheets treated as described in Example 1 were anodized in 20% sulfuric acid at room temperature to achieve an oxide weight of 1.5 grams per square meter. A silicate interlayer was provided before applying a negative working photo sensitive coating. Shelf life test results indicated that the invented substrate is comparable to the commercial DS-plate of Polychrome Corp. The press life of the invented base-plate is at least twice as long as DS-plate with an identical negative coating.

What is claimed is:

1. A process for the non-electrical or non-mechanical graining of the surface of aluminum sheet to produce a white, non-reflective matte appearance with fine honeycomb topography for lithographic printing plate production, said process comprising:

contacting said aluminum sheet with an aqueous silicate solution at a temperature between 10° C. and 120° C. for a period of time between 5 seconds and 5 minutes; to provide a silicated sheet; and etching said silicated sheet chemically or electrolytically.

2. The process of claim 1 including the further steps of etching and desmutting the sheet before contacting with silicate and rinsing the silicated sheet with water before etching.

3. The process of claim 1 wherein said sheet is contacted with aqueous silicate at a temperature between 20° C. and 100° C.

4. The process of claim 3 wherein said sheet is contacted with aqueous silicate at a temperature between 80° C. and 95° C.

5. The process of claim 1 wherein said silicate is selected from the group consisting of silicates prepared from Group IA, IIA, IIIA, IB, IIB, IVB and VIII elements of the Periodic Table.

6. The process of claim 1 wherein said aqueous silicate comprises at least 0.5 weight percent silicate.

7. The process of claim 1 wherein said aqueous silicate comprises between 4 and 5 weight percent sodium silicate.

8. The process of claim 1 wherein said silicated sheet is etched in a solution of aqueous alkali at a pH greater than 12 at a temperature between 20° C. and 100° C. for a period of time between 5 seconds and 5 minutes.

9. The process of claim 8 wherein said alkali is selected from the group consisting of sodium hydroxide, potassium hydroxide, lithium hydroxide, trisodium phosphate and tripotassium phosphate.

10. The process of claim 1 wherein said silicated sheet is etched in aqueous acid solution.

11. The process of claim 1 wherein said silicated plate is electrolytically etched in aqueous acid or alkaline solution.

* * * * *